United States Patent [19]

Barge

[11] 4,445,504

[45] May 1, 1984

[54] CHIROPRACTIC ADJUSTMENT TABLE

[76] Inventor: Fred H. Barge, 322 Cameron Ave., LaCrosse, Wis. 54601

[21] Appl. No.: 326,744

[22] Filed: Dec. 2, 1981

[51] Int. Cl.[3] ..... A61H 5/00

[52] U.S. Cl. ..... 128/70

[58] Field of Search ..... 128/70, 71, 73, 74, 128/75; 297/391, 408, 410

[56] References Cited

U.S. PATENT DOCUMENTS

| | | | |
|---|---|---|---|
| 1,228,953 | 6/1917 | Naysmith | 128/73 |
| 3,998,218 | 12/1976 | Lane et al. | 128/70 |
| 4,082,354 | 4/1978 | Renner et al. | 297/410 |
| 4,314,552 | 2/1982 | Moon | 128/70 |

*Primary Examiner*—Richard J. Apley
*Assistant Examiner*—David J. Brown
*Attorney, Agent, or Firm*—Harvey B. Jacobson

[57] ABSTRACT

A chiropractic examination table having a cushioned headpiece, pelvic piece or member hingedly connected and supported by a chiropractic table apparatus, the table apparatus having a solenoid or compressed air piston mounted end table, a movable core of the solenoid or compressed air piston being displaced abruptly, in a sudden and rapid manner upward upon energization of the solenoid or compressed air piston for a momentary period of time during which the separate member is abruptly raised a controlled distance for treating the patient under chiropractic examination, and after the momentary period of time, the member returns to its initial rest position, thus completing the chiropractic adjustment and treatment. The table may have one or more separate headpieces, pelvic pieces or members each of which or both being selectively actuated for the upward abrupt thrust actuation and treatment of the chiropractic patient.

20 Claims, 5 Drawing Figures

10
12
44
52
50
20
32
34
36
26
40

10
12
14
16
18
20
22
26
28
36
38
40
44
46
50
52

CHIROPRACTIC ADJUSTMENT TABLE

BACKGROUND OF THE INVENTION

The present invention relates to a chiropractic examination and treatment table constructed to provide abrupt upward displacement of a separate headpiece, pelvic piece or member for providing a force to adjust, treat or act upon a given vertebra, or the pelvis. The member is displaced upwardly a controlled distance for a selected and prescribed treatment and adjustment. More particularly, the invention relates to a table for use of chiropractors in administering chiropractic adjustment and treatments for the correction of subluxations or abnormal positions or conditions of a vertebra, pelvis, a spinal nerve, or artery, discs or other related portions of a given area in the cervical, pelvic and other regions of the human spinal column, and in which the treatment comprises a selected, uniform and fixed upward displacement of the headpiece, pelvic piece or cushion.

Field of the Invention

Chiropractic tables as well as chiropractic treatments applied to chiropractic patients provide for tables having cushions for absorbing downward movements of the chiropractor's hand and such forces are not always consistently of a uniform force. Also, the head usually rests upon a cushion and some of the force is absorbed into the cushion. Cushions absorb different amounts of force depending upon age and other factors, and thus it is not always discerned that a uniform force is applied to the portion of the patient being treated. Until now, tables have had drop mechanisms that allowed sections of the table to drop a given fraction of an inch and thus facilitate the osseous adjustment. This adjustment force is delivered by the chiropractor. Also, it is known that other devices have been developed that deliver a thrust to the spine and these devices, sometimes appropriately dubbed adjusting guns, were held by the doctor against the patient's spine and by triggering a mechanism they delivered a controlled force to the spine articulation. Such devices lack the ability to "feel" just when the patient relaxed and thus were handicapped by not being able to deliver the force at the appropriate time. The idea of the invention is for a proposed apparatus in chiropractic adjusting mechanisms in which the force of the adjustment is applied through the surface that the patient lies upon, whether it is any portion of the adjusting table or a head cushion or the like. The concept of the invention is to provide a table member that delivers the force in controlled, ascertainable and predetermined force values and in which the doctor's hand is still required to be used on the articulation to be adjusted. By varying his contact on the articulation, he can change, affect and otherwise control the line of direction or drive of the force and this removes strain from the adjusting doctor providing for uniform and consistent treatment as applied by the adjusting mechanism. Further, a doctor's reflex speed, agility and other factors may not be consistent and may vary as to his age, or other factors, and by the means of the invention, the speed of the mechanism acting upon the cushion can be made superior to that under ordinary conditions available to the doctor. The doctor's hand, however, can control the directional application of the force and also provide torque to the adjustment, the use of the doctor's hand also maintains the element of "feeling" by the doctor just when the force should be delivered. The force is applied by a foot actuation switch or similar control mechanism. The concept of the invention relates to cushions on adjusting tables where a controlled force is desired to be applied to the spine articulation or pelvic articulation thus adjusting the patient.

Description of the Prior Art

The art of chiropractic tables for chiropractic examination and treatment of a patient have been known particularly where the tables have had drop mechanisms that allowed sections of the table to drop a given fraction of an inch and thus facilitate osseous adjustments. Various prior art arrangements are exemplary as shown in the following U.S. Patents:

| | | |
|---|---|---|
| 2,208,945 | B. S. Miller | July 23, 1940 |
| 2,622,950 | R. L. Nimmo | Dec. 23, 1952 |
| 3,113,770 | B. T. Rutledge | Dec. 10, 1963 |
| 3,226,160 | R. W. Page | Dec. 28, 1965 |
| 3,998,218 | K. G. Lane et al | Dec. 21, 1976 |

The patent to Lane et al discloses a chiropractic table utilizing a foot-operated switch to facilitate the adjustment of the table contour, such contour including a movable head cushion operable attached to a screw jack arrangement. Similarly, the patent to Rutledge discloses a chiropractor's table having an adjustable head rest operated by an appropriate linkage system. The patent to Nimmo discloses a further chiropractic table employing a head rest portion which is variously positionable through the use of a mechanical adjustment means. While all of these patents disclose the use of adjustable head rests, the adjustment mechanisms associated with head rests are not specifically designed to affect rapid movements of the head rest so as to permit the table to deliver a therapeutic force to a patient which would normally be delivered by a doctor. The patents to Page and Miller are primarily for the purpose of showing the current state of the art. None of these patents considered singly or in combination with each other is believed to have a bearing on the patentability of any claim of the invention.

SUMMARY OF THE INVENTION

An object and advantage of the present invention is to provide a chiropractic examination table and mechanism arrangement that provides for particular adjusting of spinal and pelvic articulations. The apparatus provides for a new field of spinal adjusting and manipulation not appreciated and used in chiropractic adjusting where consistent, uniform and predetermined distances of abrupt, sudden and rapid movement are to be used and applied by the table itself.

Another object and advantage of the present invention is to provide a system having a device such as a solenoid or compressed air piston arrangement for delivering a force upward against a head cushion, pelvic cushion or other member and thus delivering a force to the anatomical portion of the patient placed on the cushion for chiropractic treatment.

A further and additional object of the present invention is to provide a pelvic cushion constructed and arranged so that each side of the cushion is separately raised and separately provides for delivery of a force which can be separately or simultaneously applied depending upon an electrical switch arrangement.

Yet another object of the invention is to provide a pelvic cushion for a chiropractic adjusting table arrangement so that the adjusting table, or one portion thereof, is raised higher than the other side or portion and thus places a torsion or torsion effect upon a portion of the patient such as the pelvis to facilitate a pelvic adjustment, for example.

Yet still a further object of the present invention is to provide a pelvic cushion apparatus for a chiropractic adjusting table for delivering a therapeutic force of a given, fixed and predetermined adjustment.

An additional and yet still another object of the present invention is to provide an adjusting table which is arranged or has a component which is arranged and mechanized so that individual sections of the table can deliver a force applied for treatment of the patient and in which the force, when applied opposite to the force directed by the chiropractor's hand held against the articulation to be moved will thus move the articulation.

A concluding object of the present invention is to provide a machine and apparatus that will take abusiveness out of delivering the force from the person of the chiropractor, and in which the chiropractic patient will benefit by the ability of the device to be consistent, and often superior, in the speed and manner in which the adjustment force is applied to the chiropractic patient.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
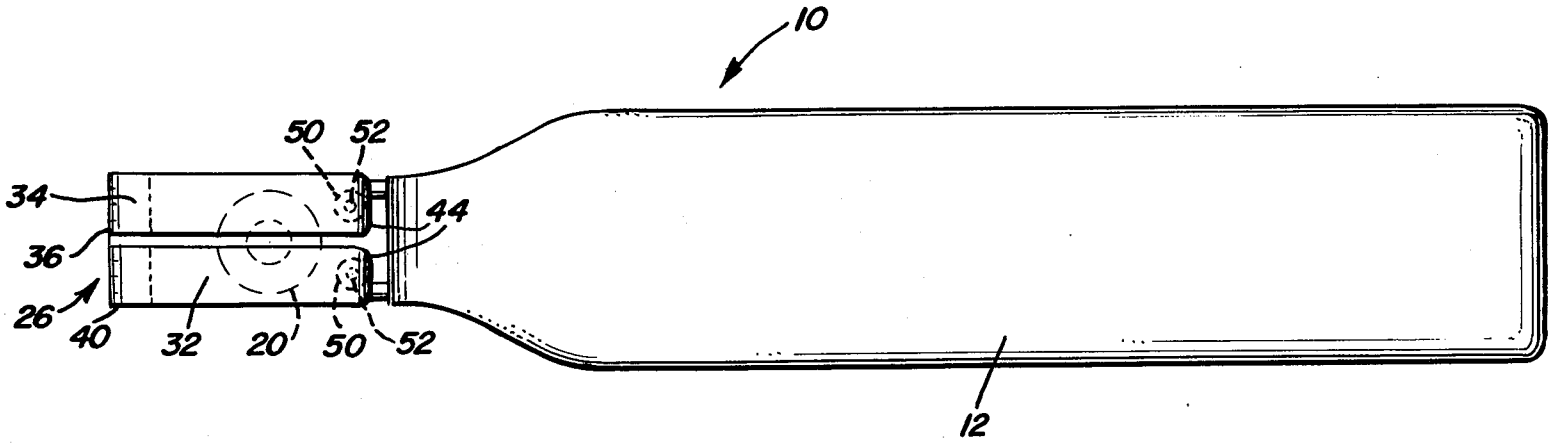
FIG. 1 is a plan view of a chiropractic examination table according to a preferred embodiment of the present invention.

Referring now to the drawings, there is shown a chiropractic examination table and treatment apparatus 10 having a table bed 12 supported on a frame 14 having legs 16 at one end and supports 18 at the other end secured onto and around a hydraulic mechanism 20. The hydraulic mechanism includes a movable member 22 that is coupled to a piston and cylinder arrangement (not shown) so that the hydraulic mechanism raises and lowers a headpiece 26 as well as providing for the headpiece to rotate, as desired. The hydraulic mechanism is controlled in its raising and lowering movement by a hydraulic pump lever 28 in a conventional and well known manner.

The headpiece 26 is provided with resting cushions 32, 34 providing a resting place for the patient's head when the patient is placed on the table bed 12. The patient may be placed on the table bed in a side posture position so that he faces horizontally when on the table bed 12 shown in FIG. 2. The movable member 22 controlled by the hydraulic pump lever 28 provides for rotation as well as raising and lowering of the headpiece supported by the hydraulic mechanism 20. An end or back 36 of the headpiece is held to the base member 38 by a hinge 40 so that the cushion headpiece 26 may have its distal end 44 raised as shown in phantom at 46. Separate headpieces 26 are illustrated in FIG. 1 and may have further separate components (not shown). Also, the table bed 12 may similarly comprise two or more separate components forming the table bed.

Figure 2:
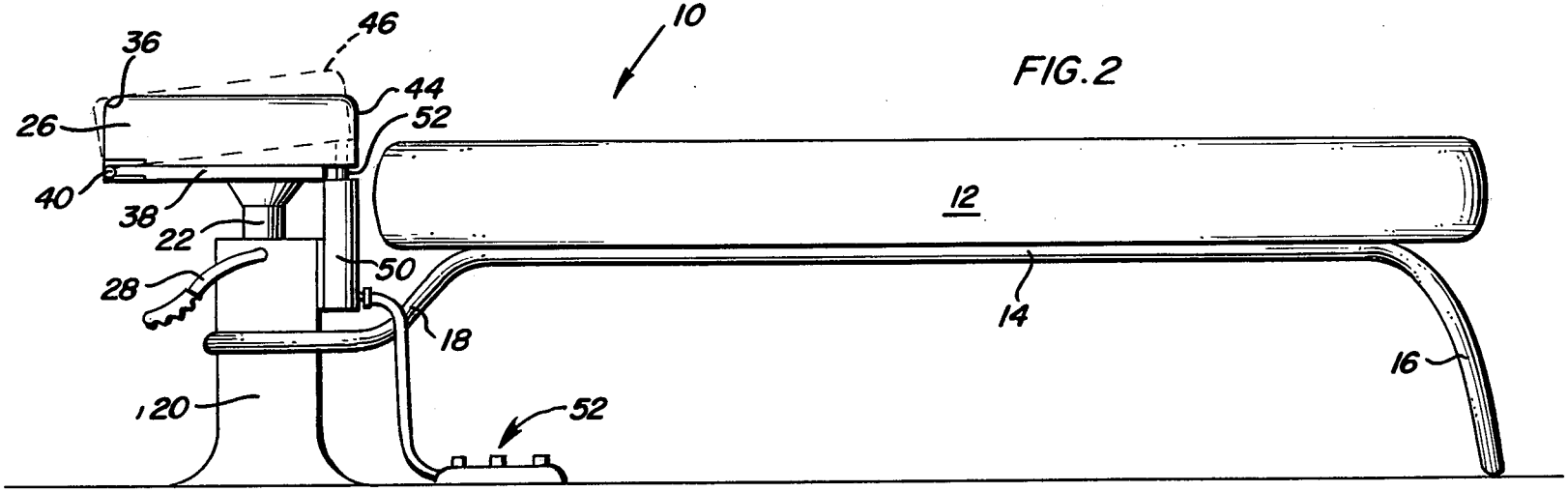
FIG. 2 is a front elevational view thereof.

The base plate 38 is affixed essentially to the top of the movable member affixed on the hydraulic cylinder. Supported in fixed relation to the hydraulic mechanism 20 is an abrupt actuating member or solenoids or compressed air pistons 50 controlled by a foot switch 52 that controls and activates the solenoids or compressed air pistons 50. The solenoids or compressed air pistons 50 comprise one or more solenoids that control a movement member or pin 52 having at its upper end a coupling or contact member that passes through the base plate 38 and engages a lower surface of the headpiece 26. The solenoids or compressed air pistons 50 include a component solenoid winding so that when one of the buttons of foot switch 52 is closed, one or several of the windings of solenoids 50 are energized so that its associated pin 52 is abruptly raised a controlled distance in a sudden and rapid manner and raises the headpiece 26 where it contacts the pin 52 a corresponding controlled distance. These distances can be adjusted so that the pin is displaced a selected interval between $\frac{1}{8}$ inch to $1\frac{1}{2}$ inches in $\frac{1}{8}$ increments, and similarly the fractional distances can be set out as a series of metric measurements. The solenoids or compressed air pistons 50 need not be an electric actuator, but may as well be any known mechanism that abruptly may displace a shaft member or pin through a selective and controlled fractional distance such as between a $\frac{1}{8}$ inch and $1\frac{1}{2}$ inches and the like, and may include a hydraulic mechanism, other electric mechanisms or a compressed air system. As seen in FIGS. 1 and 2, the patient lies on either side of his body with his head placed on the headpiece 26 and one or several of the component headpieces 26 is actuated at a given time determined by depression of the foot switch 52 while the chiropractor places his hand on the patient's neck or other appropriate vertebra to be adjusted. When the headpiece is then activated by depression of switch 52, the switch activates the mechanism or solenoids 50 that abruptly raises a corresponding headpiece 26 against the chiropractor's hand which is pressed downward against the patient's neck, and thus creates a necessary force for accomplishing the vertebral adjustment and treatment. If desired, the headpiece can be angularly displaced clockwise or counterclockwise about member 22, and correspondingly, the headpiece may be relocated, raised or lowered by the use of the manually controlled pump lever 28 as is accomplished in conventional systems.

The mechanism and system of FIGS. 1 and 2 provide an arrangement for delivering a selected force in the nature of an abruptly upward movement upon one or several component head rests while the doctor's hand is still used and urged downwardly on the articulation to be adjusted. By varying this contact and the amount of upward force or forces it can change and affect the line of drive or direction of the force or forces so that a prescriptional and remedial adjustment and treatment is applied to the patient. The doctor's hand controls the directional application of the force or forces and also provides torque to the adjustment or treatment desired. The use of the doctor's hand also maintains an element of personal contact or "feeling" by the doctor just when the force should be delivered.

Figure 3:
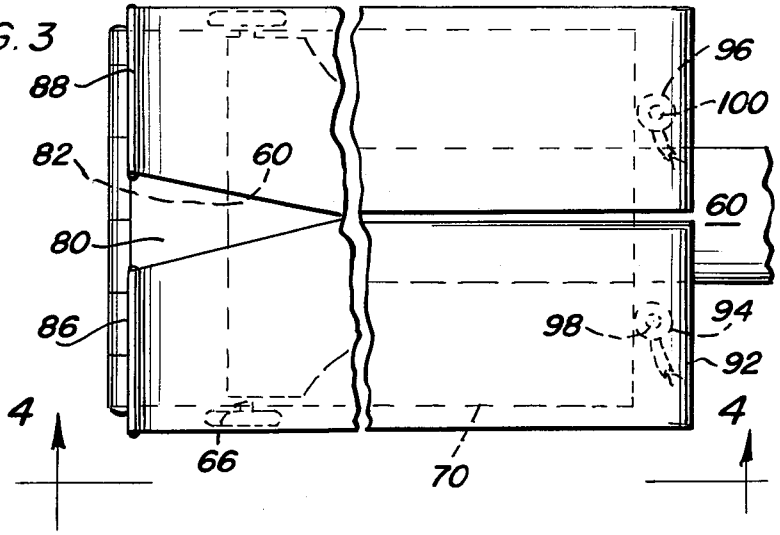
FIG. 3 is a plan view of another preferred embodiment of the invention.
Figure 5:
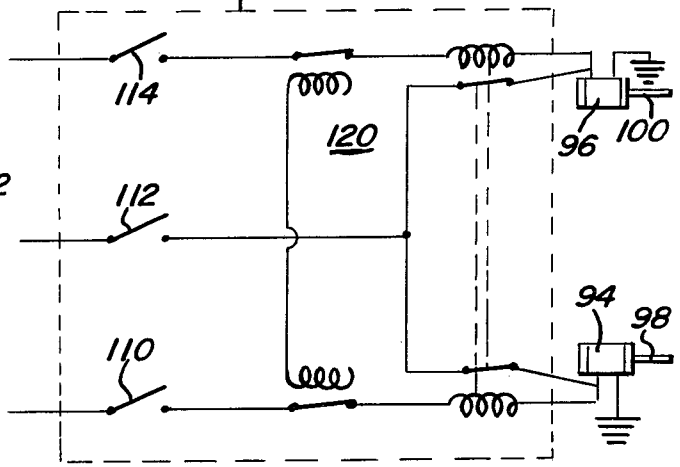
FIG. 5 is a schematic circuit diagram of details for selectively and abruptly actuating solenoids or compressed air pistons for a chiropractic examination table.
Figure 4:
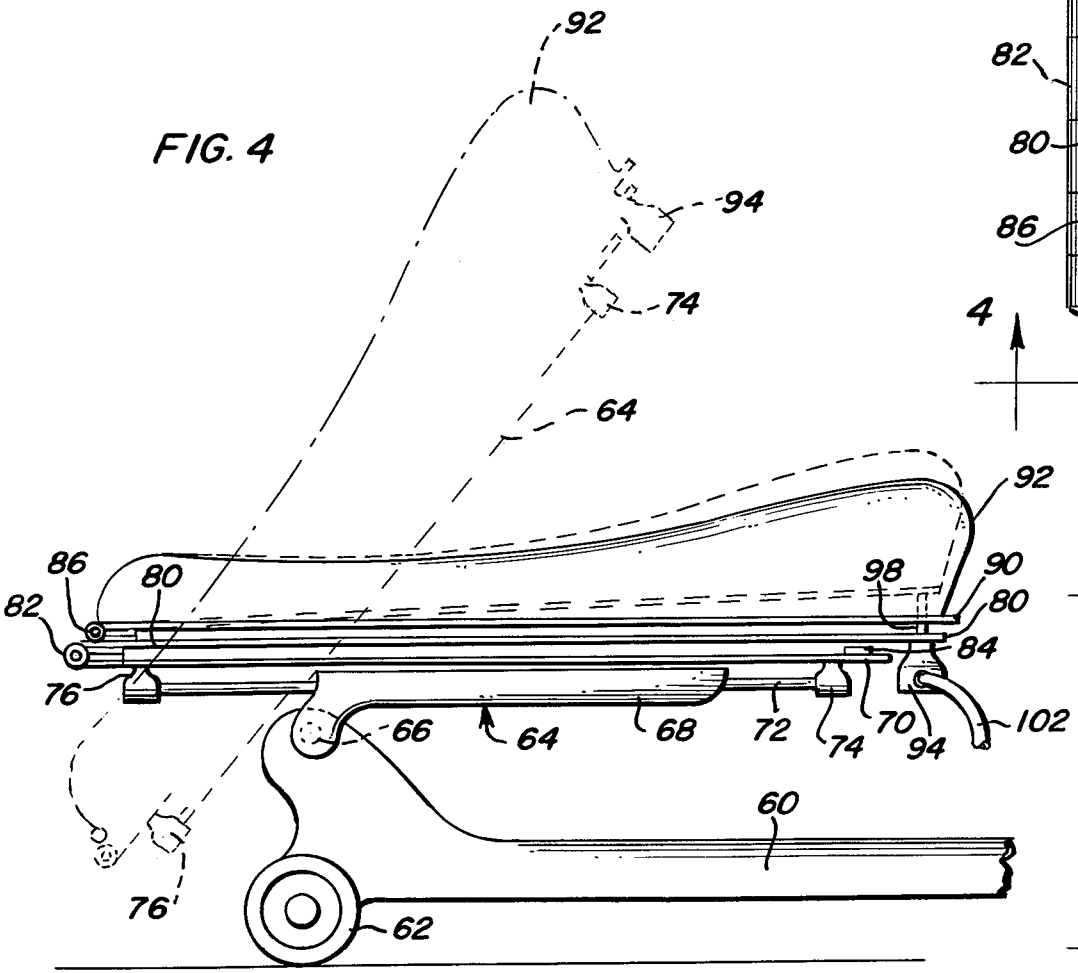
FIG. 4 is an enlarged and front elevational view taken along lines 4—4 of FIG. 3.

In FIGS. 3 and 4, a pelvic cushion for a spinal adjusting device for chiropractic examination and treatment includes a frame 60 supported by wheels 62. The frame supports a tilt bed table 64 and pivot connection 66 so that the tilt bed table 64 may move to an inclined position shown in FIG. 4. The tilt bed table 64 has a base frame 68 that supports and adjusting table 70 by longitudinal support rods 72 which pass through the adjusting frame 68 in sliding relation. The longitudinal support rods are mounted at each end on support members 74, 76. The longitudinal support rods 72 are secured to the adjustable frame 68 in affixed relation by conventional means (not shown). At the left end of the adjusting table 70, the adjusting table is coupled to a plate 80 by a hinge element such as piano hinge 82 while at the other end the plate 80 is supported from the adjusting table 70 by a block member 84. Separate and further piano hinges 86, 88 secured to the plate 80 are coupled to each of the chiropractic cushion plates 90 each of which support the a chiropractic cushion 92. At the free end of the plate 80, there is mounted on an abrupt actuator mechanism such as a solenoid or compressed air piston 94 having an actuator member or pin 98 extending through an opening in the plate 80 (not shown) and having the free end of the pin 98 to contact an underside of the cushion plate 90.

The solenoid 94 may comprise one or more distinct solenoid elements, or compressed air pistons, one for each cushion, or one for each displacement distance to be accomplished in chiropractic examination and treatment, whether a $\frac{1}{8}$, $\frac{1}{4}$, $\frac{1}{2}$ . . . to $1\frac{1}{2}$ inches. The solenoids 94, 96 are connected to control means over line 102 to a control box and switch 104 which includes separate actuator switches 110, 112, 114. The control box and switch 104 includes a circuit 120 that provides logic control of the solenoids 94, 96 so that when switch 110 is closed, only solenoid 94 is energized to actuate the abrupt movement of pin 98, and when switch 112 is closed, both of the solenoids 94, 96 are actuated to abruptly displace the pins 98, 100, and further when switch 114 is closed, only solenoid 96 is energized for the displacement of its pin 100 for the abrupt movement and treatment that is applied to the patient. Thus, while each of the respective switches is independently closed, it is not possible to further actuate an unwanted solenoid action even though its corresponding switch is closed. When one of the switches 110, 112, 114 is first closed, the other circuits are locked out and cannot be caused to apply unwanted abrupt sudden and rapid movements on the respective pins 98, 100. Within the purview of the invention, by indexing the rotation of the pins 98, 100 and in which the pins cooperate with an indexing member, it is possible to control the index so that the respective pin or pins 98, 100 are displaced through a controlled and selected distance of $\frac{1}{8}$, $\frac{1}{4}$, $\frac{3}{8}$, $\frac{1}{2}$ . . . to $1\frac{1}{2}$ inches depending upon the desired selection.

The patient, when not conveniently capable of placing himself on the table, can be positioned on the cushion 92 when the cushion is in an inclined position such position being shown in FIG. 4, and by the patient inclining himself onto the cushion 92, the patient is then tilted into a horizontal position on the cushion so that the system can be usefully applied for delivering the therapeutic force or forces of the adjustment applied to the patient.

Within the purview of the invention, the cushion 92 is provided with a mechanism 94 for delivering a force or forces abruptly upward against the cushion thus delivering the force or forces to the anatomical portion or portions of the patient that is placed on the cushion. The cushion may be arranged for pelvic adjustment and treatment so that each side of the cushion can be separately raised, and each side of the cushion can deliver a force either separately or simultaneously depending upon which of the switches 110, 112, 114 is closed. A pelvic cushion arranged so that a patient can be inclined and received onto the cushion during tilt can include spring lifts or hydraulic lifts in their operation such as is commercially available in the Zenith hydraulic electric table, and its spring lift model modifications.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A chiropractic examination table apparatus comprising a support table including a separate vertically adjustable cushion generally registered horizontally herewith actuating means to abruptly, suddenly and rapidly raise the cushion means a controlled vertical distance.

2. The invention of claim 1 wherein the cushion means includes a headpiece adjustably rotated, raised and lowered from a supportive base by means of a hydraulic member.

3. The invention of claim 1 wherein the cushion means includes a headpiece hingedly supported from a base member.

4. The invention of claim 1 wherein the cushion means comprises a headpiece including a forward portion free to rise on an impact of the actuating means.

5. The invention of claim 1 wherein the actuating means is electrically actuated in response to depression of a foot switch means.

6. The invention of claim 1 wherein the cushion means comprises a headpiece divided into separate vertically shiftable component cushioned headpieces and the actuating means includes separate actuating means for each of the component cushioned headpieces.

7. The invention of claim 6 wherein the separate component cushioned headpieces comprises at least two members spaced apart transversely of the table.

8. The invention of claim 7 wherein the spacing between the separate component cushioned headpieces is fixed.

9. The invention of claim 1 wherein the cushion means includes more than one separate headpiece and the activating means includes means to selectively and abruptly raise the headpieces through controlled fractional distances.

10. The table apparatus of claim 1 wherein said table includes an elongated main stationary bed and said separate cushion means is disposed at one end of said stationary bed.

11. The table apparatus of claim 21 wherein said separate cushion means comprises a pair of separate cushion means.

12. A chiropractic examination and treatment apparatus comprising an adjusting table frame supporting a slidable frame and plate assembly means, a plate means supported by the plate assembly means and connected by hinge means to the plate assembly means at one end thereof and having actuating member and pin means mounted at the other end, a cushion and plate assembly means supported by the plate means, connected thereto by further hinge means at the one end and arranged to be contacted by the pin at the other end, and means to energize the actuating member and pin means to abruptly, suddenly and rapidly raise the cushion and plate assembly means a controlled fractional distance.

13. The invention of claim 12 wherein the actuating member and pin means includes a solenoid including and a displaceable movement member capable of being displaced a distance selected between $\frac{1}{8}$ inch and $1\frac{1}{2}$ inches.

14. The invention of claim 12 wherein the slidable frame and plate assembly means supports a plurality of said cushion and plate assembly means, and at least one actuating member and pin means provided for each one of the plurality of said cushion means.

15. The invention of claim 12 wherein the actuating member and pin means is actuated by circuit means including means to energize the actuating member and pin means so that there is only a selected fractional distance of displacement thereof.

16. The invention of claim 12 wherein manual means raises and lowers and the cushion and plate assembly for positionally adjusting the plate assembly means.

17. The invention of claim 12 wherein switch control means is provided for selectively energizing one of said actuating member and pin means.

18. A chiropractic examination table having a separate vertically shiftable headpiece generally horizontally registered with the examination table, a direct acting solenoid operated support and raising mechanism supporting said headpiece relative to said table for abrupt, sudden and rapid upward displacement of said headpiece relative to said table a controlled fractional distance while a patient disposed in reclining position on the table with his head on the headpiece and and a chiropractor's hand is placed on an appropriate vertebras in the patient's back, so that upon activation of the mechanism, the headpiece is raised abruptly a predetermined fractional distance creating a force to adjust the given vertebra.

19. The invention of claim 18 wherein said table includes means for vertical and rotational adjustment of said headpiece independent of said head mechanism.

20. The invention of claim 18 wherein the table includes a fixedly secured bed supported thereby.

* * * * *